United States Patent [19]

Yoshihara et al.

[11] Patent Number: 4,855,202

[45] Date of Patent: Aug. 8, 1989

[54] ELECTROPHOTOGRAPHIC PHOTOSENSITIVE MEMBER

[75] Inventors: Toshiyuki Yoshihara, Mitaka; Tomohiro Kimura, Yokohama, both of Japan

[73] Assignee: Canon Kabushiki Kaisha, Tokyo, Japan

[21] Appl. No.: 165,099

[22] Filed: Mar. 7, 1988

[30] Foreign Application Priority Data

Mar. 10, 1987 [JP] Japan ..... 62-52882

[51] Int. Cl.[4] ..... G03G 5/06

[52] U.S. Cl. ..... 430/58; 430/56; 430/59; 430/96; 430/134; 430/135

[58] Field of Search ..... 430/96, 58, 59, 56, 430/134, 135

[56] References Cited

U.S. PATENT DOCUMENTS

| | | | |
|---|---|---|---|
| 3,378,370 | 4/1968 | Brancato | 430/96 X |
| 4,030,923 | 6/1977 | Krause et al. | 430/58 |
| 4,175,961 | 11/1979 | Wright et al. | 430/58 |
| 4,301,224 | 11/1981 | Kozima et al. | 430/58 |
| 4,353,971 | 11/1982 | Chang | 430/56 X |
| 4,559,285 | 12/1985 | Hoffmann | 403/96 X |
| 4,618,552 | 10/1986 | Tanaka et al. | 430/58 X |

*Primary Examiner*—Paul R. Michl
*Assistant Examiner*—Jeffrey A. Lindeman
*Attorney, Agent, or Firm*—Fitzpatrick, Cella, Harper & Scinto

[57] ABSTRACT

An electrophotographic photosensitive member having the structure comprising a conductive substrate laminated thereon with (i) a charge generation layer comprising two or more kinds of charge-generating materials incorporated in binder resins and (ii) a charge transport layer at least a first charge generating material dispersed in a first binder resin and a second charge generating material dispersed in a second binder resin, such that the binder resins in the charge generating layer are incompatible with each other.

10 Claims, No Drawings

ELECTROPHOTOGRAPHIC PHOTOSENSITIVE MEMBER

BACKGROUND OF THE INVENTION

1. Field of the Invention

The present invention relates to an electrophotographic photosensitive member, and, more particularly, to an electrophotographic photosensitive member having a wide sensitivity region over the visible light to infrared regions.

2. Related Background Art

Hitherto known are electrophotographic photosensitive members in which inorganic photoconductive material such as selenium, cadmium sulfide and zinc oxide are utilized as photosensitive components.

On the other hand, since discovery of the fact that particular organic compounds show photoconductivity, a great number of organic photoconductive material have been developed. For example, known are organic photoconductive polymers such as poly-N-vinyl carbazole and polyvinyl anthracene, low molecular organic photoconductive materials such as carbazole, anthracene, pyrazolines, oxadiazoles, hydrazones and polyarylalkanes, and organic pigments or dyes such as phthalocyanine pigments, azo pigments, cyanine dyes, polycyclic quinone pigments, perylene type pigments, indigo pigments or squaric acid methine dyes.

In particular, since the organic pigments or dyes having photoconductivity can be readily synthesized as compared with inorganic materials and moreover have gained extended variations from which the compounds having the photoconductivity at any suitable wavelength region can be selected, there have been proposed a great number of photoconductive organic pigments or dyes.

For example, as disclosed in U.S Pat. No. 4,123,270, U.S. Pat. No. 4,247,614, U.S. Pat. No. 4,251,613, U.S. Pat. No. 4,251,614, U.S. Pat. No. 4,256,821, U.S. Pat. No. 4,260,672, U.S. Pat. No. 4,268,596, U.S. Pat. No. 4,278,747, U.S. Pat. No. 4,293,628, U.S. Pat. No. 4,356,243, U.S. Pat. No. 4,471,040, U.S. Pat. No. 4,582,771, etc., known are electrophotographic photosensitive members wherein disazo pigments showing photoconductivity are used as charge-generating materials in photosensitive layers functionally separated into charge generation layers and charge transport layers.

The electrophotographic photosensitive members employing such organic photoconductive materials can be produced by coating with suitable selection of binders. Accordingly, they are advantageous in that the productivity is so high that there can be provided inexpensive photosensitive members and moreover the photosensitive wavelength region can be arbitrarily controlled by selecting the organic pigments or dyes.

In particular, lamination type photosensitive members obtained by laminating a charge transport layer and a charge generation layer chiefly comprised of charge-generating materials are advantageous in sensitivity and in the increase in the residual electric potential after durability testing as compared with other single layer type photosensitive members, and have already put into practical use.

On the other hand, when controlling the photosensitive wavelength region by selecting the charge-generating materials, it is difficult to find a material (or panchromatic material) having a wide photosensitive wavelength region with a single material. For this reason, as disclosed in U.S. Pat. No. 3,992,205, U.S. Pat. No. 4,026,704, etc., it is known to mix two or more kinds of charge-generating materials having different photosensitive wavelength region.

In this instance, however, there occur other problems originating from the charge-generating materials contained in the different two or more kinds.

Since in general the charge-generating materials have no film-forming properties when used alone, the charge generation layer is formed by coating a solution prepared by dispersing the materials in a solvent and a binder resin. However, because of the respectively different dispersibility of the charge-generating materials, it is difficult to simultaneously disperse the charge-generating materials of two or more kinds.

Even when the solutions prepared by separately dispersing the materials are mixed, the agglomeration between dispersed particles of the different charge-generating materials tends to occur and good stability cannot be obtained.

If a charge generation layer is formed in this manner, its properties as an electrophotographic photosensitive member are not sufficient, bringing about the problems such that, for example, the sensitivity of a certain charge-generating material at the maximum absorption peak wavelength becomes lower than the instance where a charge generation layer has been formed by using it alone, or the dark decay and light memory are too large to obtain stable images in repeated electrophotographic processes.

SUMMARY OF THE INVENTION

An object of the present invention is to provide an electrophotographic photosensitive member free from agglomeration between the different charge-generating materials or lowering of sensitivity, in electrophotographic photosensitive members having a charge generation layer comprising two or more kinds of mixed charge-generating materials.

Another object of the present invention is to provide a superior electrophotographic photosensitive member achieving a lowered dark decay and being free from memory phenomenon.

A further object of the present invention is to provide a panchromatic electrophotographic photosensitive member having a high sensitivity over the visible light to infrared regions and capable of obtaining an image of high grade in a stable state.

According to the present invention, there is provided an electrophotographic photosensitive member having the structure comprising a conductive substrate laminated thereon with (i) a charge generation layer comprising two or more kinds of charge-generating materials incorporated in binder resins and (ii) a charge transport layer, characterized in that said charge generation layer comprises said charge-generating materials dispersed in the binder resins that are not compatible with each other.

DETAILED DESCRIPTION OF PREFERRED EMBODIMENTS

In the charge generation layer based on the present invention, the two or more kinds of charge-generating materials are respectively dispersed in the binder resins that are not compatible with each other.

Accordingly, the dispersed particles of each charge-generating material only contact the particles of the other charge-generating material with difficulty, thus causing no agglomeration.

This also enables good efficiency in the absorption of the light at a specific absorption wavelength region possessed by the respective charge-generating materials.

There is also no formation of barriers owing to the contact with the different charge-generating materials, and also the quantity of the free carriers in the layer, having relatively long lives, can be decreased to lessen the memory phenomenon. Therefore, there can be achieved the prevention of a great lowering of the dark decay and the chargeability in continuous copying.

The combination of such binder resins that are not compatible with each other may desirably be selected on the basis of solubility parameters or structural factors, and judged taking account of the dispersibility of the respective charge-generating materials.

The combination of the binder resins of the present invention that are not compatible with each other does not substantially cause them to dissolve each other and brings about formation of a discontinuous face. Such combination can be exemplified by cellulose acetate/-polymethacrylate, polyvinyl butyral/polyester, polyvinyl butyral/polycarbonate, polyvinyl butyral/-polymethyl methacrylate, polyamide/polyvinyl butyral, polymethyl methacrylate/polycarbonate, styrene/-polymethyl methacrylate, etc.

Also, in instances where the charge-generating materials are used in three or more kinds, the binder resins to be used correspondingly may preferably be used in the combination with three or more kinds of binder resins that are not compatible with each other. In such instances, however, greatly improved performances can be exhibited as compared with the instance where a single kind of binder resin is used, even if the combination comprises two kinds of binder resins.

The charge-generating material may include pigments or dyes as shown below and as exemplified by organic materials such as pyrylium type dyes, thiapyrylium type dyes, phthalocyanine pigments, anthanthrone pigments, dibenzypyrenequinone pigments, pyranthrone pigments, trisazo pigments, diazo pigments, monoazo pigments, indigo pigments, quinacridone pigments, unsymmetrical quinocyanine and quinocyanine, and besides, in some instances, inorganic photoconductive materials such as sensitized zinc oxide can be used in combination.

Two or more kinds of charge-generating materials may be selected from these charge-generating materials so that the sensitivities can be covered from the visible light to infrared regions, specifically between 400 and 850 nm.

The charge generation layer can be obtained by dispersing the above charge-generating materials in a solution of the respectively selected binder resins and coating a coating solution mixed with the resulting dispersion on a conductive substrate.

Known methods can be suitably employed for the dispersion method and coating method.

The charge generation layer may desirably be of a thin film layer having a film thickness, for example, of 1.0 μm or less, preferably of from 0.01 to 1 μm, in order for the layer to contain the charge-generating materials in amounts as much as possible and for the charge carriers thus generated to be injected into the charge transport layer with a good efficiency. This is because a greater part of the amount of incident light is absorbed in the charge generation layer to generate many charge carriers and also because it is necessary to inject the thus generated charge carriers into the charge transport layer without their inactivation owing to the recombination or trapping.

Since in general the charge generation layer is a thin layer like this, the concentration of the coating solutions therefore is also set in a considerably low state. Accordingly, there may occur no problems of phase separation, relation or the like because of the thin concentration, even though the dispersions of the two or more kinds of charge-generating materials, containing the binder resins that are not compatible with each other are mixed.

As to the ratio of the charge-generating materials to the binder resins, its appropriate value may vary depending on the materials to be selected, but is generally from 5:1 to 1:5, preferably from 3:1 to 1:3, in approximation.

Overly low proportions of the binder resins may result in so a poor dispersibility of the charge-generating materials and so insufficient coating by the resin on the dispersed particle surfaces that the expected effect of the present invention can be obtained with difficulty.

On the other hand, overly high proportions of the binder resins can improve the dispersibility but may cause a lowering of the electrophotographic performances undesirably.

The charge-transporting material used in the present invention may be any of the charge-transporting materials generally used in lamination type electrophotographic photosensitive members, and include pyrazoline type compounds, hydrazone type compounds, stilbene type compounds, triphenylamine type compounds, benzidine type compounds, oxazole type compounds, etc.

To form the charge transport layer containing the charge-transporting material, a suitable binder may be selected to form a film. Resins used as the binder may include insulating resins as exemplified by acrylic resin, polyacrylate, polyester, polycarbonate, polystyrene, an acylonitrile/styrene copolymer, an acrylonitrile/-butadiene copolymer, polyvinyl butyral, polyvinyl formal, polysulfone, polyacrylamide, polyamide, chlorinate rubber, etc. or organic photoconductive polymers are exemplified by poly-N-vinyl carbazole, polyvinyl anthracene, polyvinyl pyrene, etc.

The charge transport layer, which has a limit at which it can transport charge carriers, can not be made to have an unnecessarily large film thickness. Generally acceptable film thickness ranges from 5 to 40 μm, but preferably from 8 to 25 μm. When the charge transport layer is formed by coating, there can be used suitable coating methods as previously mentioned.

The charge transport layer is laminated on the charge generation layer in many instances, but they can be laminated in an adverse fashion to change the polarity.

In either of the instances, a subbing layer having a barrier function and an adhesive function can also be provided between any of the above layers and the conductive substrate. The subbing layer can be formed by casein, polyvinyl alcohol, nitrocellulose, an ethylene/acrylic acid copolymer, polyvinyl butyral, phenol resin, polyamide (such as nylon 6, nylon 66, nylon 610, copolymer nylon and alkoxymethylated nylon), polyurethane, gelatin, aluminum oxide, etc. The subbing layer may appropriately have a film thickness of from 0.1 to 40 μm, preferably from 0.1 to 3 μm.

In any event, a protective layer may be provided on the surface of the photosensitive member for the purpose of preventing the deterioration due to ultraviolet rays, ozone or the like, the contamination by oil, the scratching by cuttings of metals or the like, and the scratching or scraping of the photosensitive member by members such as a cleaning member coming to contact with the photosensitive member.

In order for an electrostatic latent image to be formed on the protective layer, the protective layer may desirably have a surface resistivity of $10^{11}$ ohms or more.

The protective layer used in the present invention can be formed by coating on the photosensitive layer a solution obtained by dissolving resins such as polyvinyl butyral, polyester, polycarbonate, acrylic resin, methacrylic resin, nylon, polyimide, polyarylate, polyurethane, a styrene/butadiene copolymer, a styrene/acrylic acid copolymer and a styrene/acrylonitrile copolymer in a suitable organic solvent, followed by drying.

Besides these, as the conductive substrate, there can be used plastics having a layer formed into a film by vacuum deposition of, for example, aluminum, aluminum alloys, indium oxide, tin oxide, a indium oxide/tin oxide alloy, etc., and also substrates comprising conductive particles as exemplified by carbon black, silver particles, titanium oxide, etc. covered on plastic or the above photoconductive substrate together with a suitable binder, substrates comprising plastic or paper impregnated with conductive particles, or plastics having a conductive polymer.

EXAMPLES

Example 1

On an aluminum cylinder of 80ϕ×350 mm, a subbing layer of 0.5 μm thick was provided by dip coating of methanol solution of polyamide.

Selected as the charge-generating materials were the following two kinds:

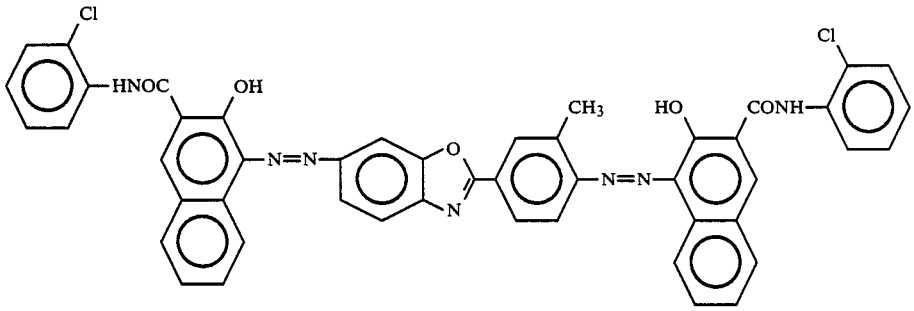

(I)

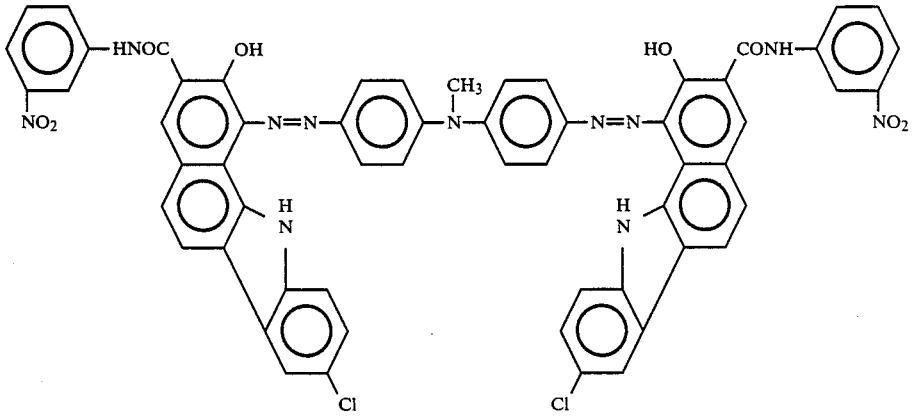

(II)

Additives such as ultraviolet absorbents can also be added in the above resin solution. Here, the protective layer may have a film thickness generally in the range of from 0.05 to 20 μm, preferably from 0.2 to 5 μm.

As the conductive substrate, there can be used the materials such that the substrate itself has the conductivity, as exemplified by aluminum, aluminum alloys, copper, zinc, stainless steel, vandium, molybdenum, chromium, titanium, nickel, indium, gold, platinum, etc.

Maximum absorption wavelength:

(I): 550 nm; (II): 750 nm.

By use of a sand mill apparatus using glass beads of 1ϕ, 10 parts (by weight; the same hereinafter) of charge-generating material (I), 5 parts of polyvinyl butyral having the structure shown below:

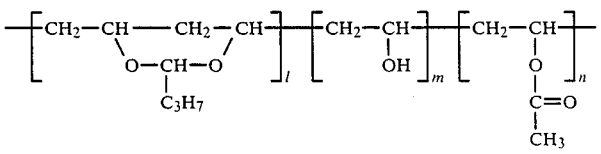

-continued (l: 45; m: 32; n: 8)

and 50 parts of cyclohexane were dispersed for 20 hours.

To the resulting dispersion, added were 450 parts of tetrahydrofuran to prepare charge generation layer coating solution (A).

Next, by use of a sand mill apparatus using glass beads 1ϕ, 10 parts of charge-generating material (II), 8 parts of polymethyl methacrylate having the structure shown below:

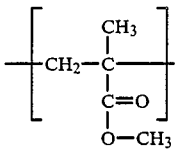

and not compatible each other with the polyvinyl butyral used for charge-generating material (I), and 60 parts of cyclohexanone were dispersed for 50 hours.

To the resulting dispersion, added were 200 parts of cyclohexanone and 240 parts of methyl ethyl ketone to prepare charge generation layer coating solution (B).

In a solution obtained by mixing the charge generation layer coating solution (A) and charge generation layer coating solution (B) in an equal amount, the above cylinder having been coated with the subbing layer was dipped to effect coating, followed by drying to form a charge generation layer of 0.3 μm thick.

Next, 8 parts of a charge-transporting material shown below:

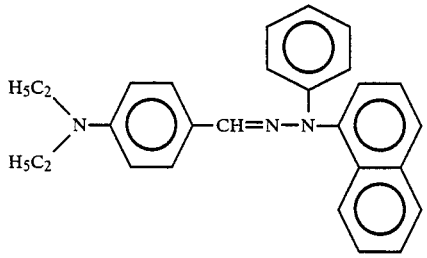

10 parts of a styrene/acrylic acid copolymer and 60 parts of monochlorobenzene were mixed and dissolved by stirring with a stirring machine.

The resulting solution was dip-coated on the charge generation layer, followed by drying to form a charge transport layer of 18 μm thick.

On the electrophotographic photosensitive member prepared in this manner, corona discharge of −5 kV was effected. Measured was the surface potential (initial potential) $V_0$ at this time. Further measured was the surface potential $V_5$ observed after this photosensitive member was left to stand for 5 seconds at a dark place.

Sensitivities were evaluated by using two types of light sources comprising a halogen lamp light source (visible light sensitivity) and a semiconductor laser beam light source (780 nm), and measuring the exposure amount $E_{\frac{1}{2}}$(μJ/cm$^2$) required for decaying the potential V5 after dark decay to ½.

This electrophotographic photosensitive member was also mounted on a copying machine (NP-3525; manufactured by Canon Inc.) to make image production. After further carrying out continuous copying for 1,000 sheets, the above potential $V_5$ was measured (expressed as $V_5^{1000}$).

Comparative Example 1

An electrophotographic photosensitive member was prepared in entirely the same manner as in Example 1 except that polymethyl methacrylate (the binder resin for the charge-generating material (II) in Example 1) was used as the binder resin for the charge-generating material (I) in Example 1, and evaluated similarly.

| | $V_0$ (−V) | $V_5$ (−V) | $E_{\frac{1}{2}}$ (visible) (μJ/cm$^2$) | $E_{\frac{1}{2}}$ (780 nm) | $V_5^{1000}$ (−V) |
|---|---|---|---|---|---|
| Example 1 | 650 | 640 | 0.41 | 1.02 | 630 |
| Comparative Example 1 | 640 | 595 | 0.52 | 1.14 | 480 |

The photosensitive member of the comparative example is recognized to be large in the dark decay and also poor in the repetition performance. There was also seen image roughness caused by the agglomeration of the charge-generating pigments.

In contrast thereto, the photosensitive member of Example 1 is recognized to have obtained an image of high grade and show good potential characteristics.

Comparative Examples 2 and 3

Prepared were electrophotographic photosensitive members in which the charge-generating material coating solutions (A) and (B) in Comparative Example 1 were respectively used alone, to make the evaluation.

| | $V_0$ (−V) | $V_5$ (−V) | $E_{\frac{1}{2}}$ (visible) (μJ/cm$^2$) | $E_{\frac{1}{2}}$ (780 nm) | $V_5^{1000}$ (−V) |
|---|---|---|---|---|---|
| Comparative Example 2 | 660 | 650 | 1.02 | — | 640 |
| Comparative Example 3 | 670 | 660 | 2.20 | 1.40 | 635 |

Thus, the photosensitive member according to Example 1 is recognized to be free from the lowering of sensitivity and the deterioration of repetition performance as compared with the instances in which the charge-generating materials were respectively used alone.

EXAMPLE 2

Charge-generating material (III) and aluminum chloride phthalocyanine were made ready for use as charge-generating materials.

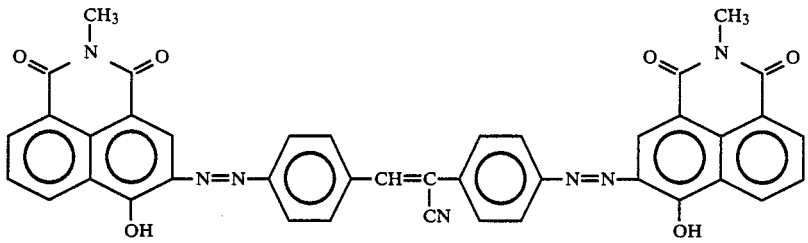

(III)

By use of a sand mill apparatus using glass beads of 1ϕ, 10 parts of charge-generating material (III), 5 parts of cellulose acetate butylate having the structure shown below:

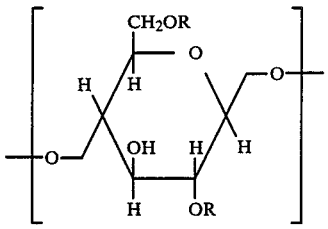

[R: $CH_3COO-$, $C_3H_7COO-$ ($CH_3COO-/C_3H_7COO-$ ≈ 1/2.8]

and 50 parts of cyclohexanone were dispersed for 20 hours.

To the resulting dispersion, added were 450 parts of methyl ethyl ketone to prepare charge generation layer coating solution (C).

Next, by use of a sand mill apparatus using glass beads 1ϕ, 10 parts of aluminum chloride phthalocyanine, 10 parts of a thermoplastic linear polyester having the structure shown below:

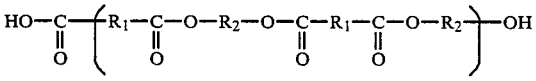

($R_1$ and $R_2$ are each an alkyl group or an aryl group)

and not compatible each other with the cellulose acetate butylate as the binder resin, and 70 parts of cyclohexanone were dispersed for 10 hours.

To the resulting dispersion, added were 200 parts of cyclohexanone and 230 parts of tetrahydrofuran to prepare charge generation layer coating solution (D).

Using a solution obtained by mixing the charge generation layer coating solution (C) and charge generation layer coating solution (D) in an equal amount, the cylinder having been coated with the subbing layer similar to Example 1 was dip-coated, followed by drying to form a charge generation layer of 0.3 μm thick.

The charge transport layer was formed in the same manner as in Example 1.

The electrophotographic photosensitive member prepared in this manner was evaluated in the same manner as in Example 1.

Comparative Example 4

An electrophotographic photosensitive member was prepared in entirely the same manner as in Example 2 except that cellulose acetate butylate same as that for the charge-generating material (III) was used as the binder resin for the aluminum chloride phthalocyanine in Example 2, and evaluated similarly.

| | $V_0$ (−V) | $V_5$ (−V) | $E_{\frac{1}{2}}$ (visible) (μJ/cm²) | $E_{\frac{1}{2}}$ (780 nm) | $V_5^{1000}$ (−V) |
|---|---|---|---|---|---|
| Example 2 | 665 | 650 | 1.05 | 1.41 | 640 |
| Comparative Example 4 | 660 | 590 | 1.31 | 1.65 | 420 |

According to the photosensitive member of Comparative Example 4, there was seen much image roughness as compared with the photosensitive member of Example 2, and the agglomeration of the charge-generating materials is presumed to have occurred.

EXAMPLE 3

Using the same coating solution as in Example 1, a charge transport layer was coated on a subbing layer, and a charge generation layer was provided thereon by spray coating to prepare a positive charge type photosensitive member.

On this photosensitive member, similar evaluation was repeated under the positive charge to find that good characteristics were shown like the case of the negative charge.

EXAMPLE 4

Selected as the charge-generating materials were the following two kinds:

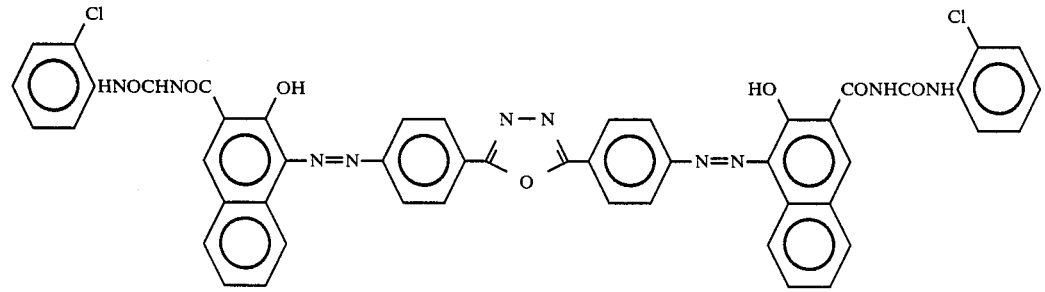

(IV)

-continued (V)

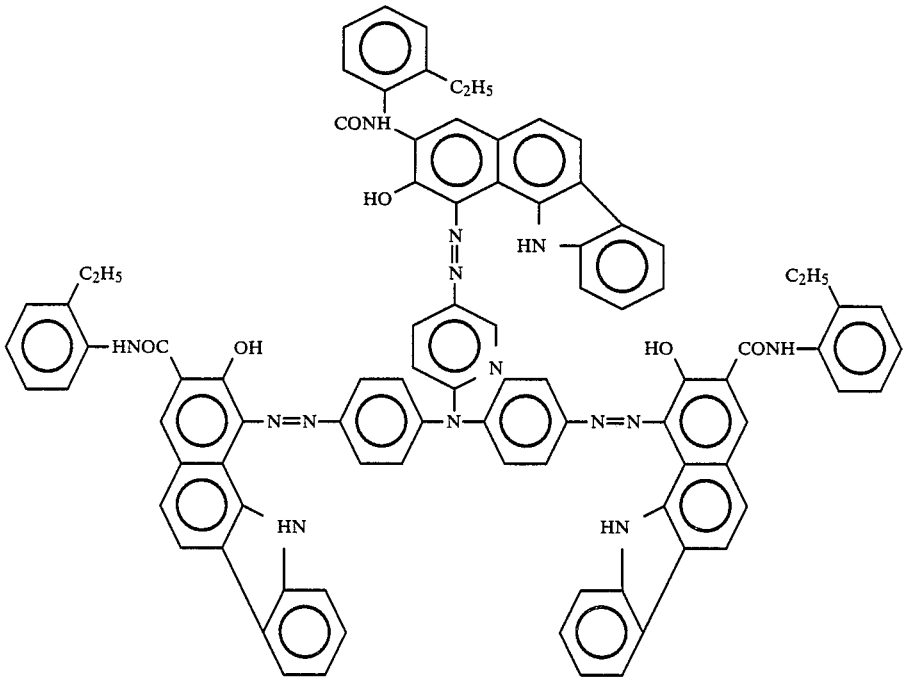

Maximum absorption wavelength:

(IV): 550 nm; (V): 750 nm.

By use of a sand mill apparatus using glass beads of 1ϕ, 10 parts of charge-generating material (IV), 5 parts of polyvinyl benzal having te structure shown below:

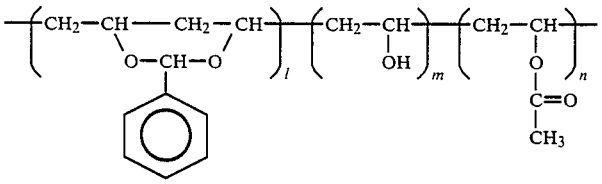

(l: 200; m: 92; n: 8), 25 parts of cyclohexane and 25 parts of tetrahydrofuran were dispersed for 20 hours.

To the resulting dispersion, added were 200 parts of cyclohexanone and 250 parts of tetrahydrofuran to prepare charge generation layer coating solution (E).

Next, by use of a sand mill apparatus using glass beads 1ϕ, 10 parts of charge-generating material (V), 8 parts of bis-phenol Z type polycarbonate having the structure shown below:

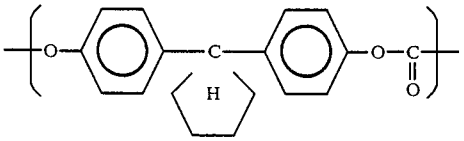

and 50 parts of cyclohexane were dispersed for 5 hours.

To the resulting dispersion, added were 250 parts of cyclohexanone and 200 parts of methyl ethyl ketone to prepare charge generation layer coating solution (F).

In a solution obtained by mixing the charge generation layer coating solutions (E) and (F) in the ratio of 2:1, the same cylinder as in Example 1, having been coated with the subbing layer, was dipped to effect coating, followed by drying to form a charge generation layer of 0.2 μm thick.

Next, 10 parts of a charge-transporting material shown below:

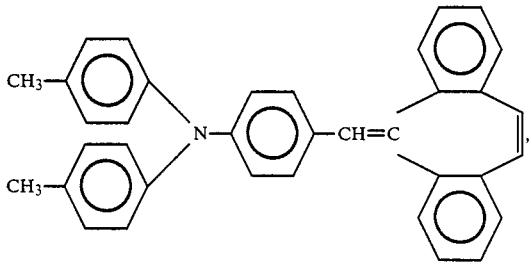

10 parts of bis-phenol A type polycarbonate were dissolved in 45 parts of dichloromethane and 15 parts of monochlorobenzene. The resulting solution was dip-coated on the charge generation layer, followed by drying to form a charge transport layer of 19 μm thick.

The electrophotographic photosensitive member prepared in this manner was evaluated in the same manner as in Example 1.

Comparative Example 4

An electrophotographic photosensitive member was prepared in the same manner as in Example 4 except that the same polyvinyl benzal resin as that for charge-generating material (IV) was used as the binder resin for the charge-generating material (V) in Example 4, and evaluated similarly.

| | $V_0$ | $V_5$ | $E_{\frac{1}{2}}$ (visible) | $E_{\frac{1}{2}}$ (780 nm) | $V_5^{1000}$ |
|---|---|---|---|---|---|
| Example 4 | 650 | 630 | 0.44 | 1.11 | 620 |
| Comparative Example 4 | 640 | 580 | 0.56 | 1.32 | 470 |

In Example 4, there was obtained a good image free of any image defficiency, but, in Comparative Example 4, there were seen a large dark decay and an image with much roughness.

We claim:

1. An electrophotographic photosensitive member having the structure comprising a conductive substrate laminated thereon with (i) a charge generation layer comprising at least a first charge generating material dispersed in a first binder resin and a second charge-generating material dispersed in a second binder resin, each said binder resin in said charge generation layer being incompatible with each other and (ii) a charge transport layer.

2. The electrophotographic photosensitive member of claim 1, wherein said charge-generating materials are two kinds, and the combination of said binder resins is selected from the group consisting essentially of cellulose, acetate/polymethylacrylate, polyvinyl butyral/-polyester, polyvinyl butyral/polycarbonate, polyvinyl butyral/polymethyl methacrylate, polyamide/polyvinyl butyral, polymethyl methacrylate/polycarbonate, and styrene/polymethyl methacrylate.

3. The electrophotographic photosensitive member of claim 1, wherein said charge transport layer is laminated on said charge generation layer.

4. The electrophotographic photosensitive member of claim 1, wherein said charge generation layer has a film thickness of 0.01 to 1 μm.

5. The electrophotographic photosensitive member of claim 1, having a photosensitive wavelength region over 400 to 850 nm.

6. The electrophotographic photosensitive member of claim 1, wherein said charge-generating materials are pigments or dyes.

7. The electrophotographic photosensitive member of claim 1, wherein said charge-generating materials are pigments.

8. The electrophotographic photosensitive member of claim 1, wherein said charge-generating materials are organic photoconductive materials.

9. The electrophotographic photosensitive member of claim 1, wherein said charge-generating materials are azo pigments or phthalocyanine pigments.

10. The product of claim 1 formed by separately dispersing each said charge-generating material in a solution of said binder resin employed therewith to form a coating solution, admixing together each said coating solution, applying said mixed coating solutions to a conductive substrate to form a charge generation layer thereon, and forming said charge transport layer on said charge generation layer.

* * * * *

UNITED STATES PATENT AND TRADEMARK OFFICE

CERTIFICATE OF CORRECTION

PATENT NO. : 4,855,202

DATED : August 8, 1989

INVENTOR(S) : TOSHIYUKI YOSHIHARA, ET AL.

It is certified that error appears in the above-identified patent and that said Letters Patent is hereby corrected as shown below:

IN [57] ABSTRACT

Line 6, "layer" should read --layer,--.

COLUMN 1

Line 19, "material" should read --materials--.
Line 63, "put" should read --been put--.

COLUMN 3

Line 43, "diazo pigments," should read --disazo pigments,--.

COLUMN 4

Line 44, "nate rubber," should read --nated rubber,--.
Line 45, "are" should read --as--.
Line 56, "adverse" should read --inverse--.

COLUMN 6

Line 4, "a" should read --an--.

COLUMN 8

Line 12, "V5" should read --$V_5$--.

UNITED STATES PATENT AND TRADEMARK OFFICE

CERTIFICATE OF CORRECTION

PATENT NO. : 4,855,202

DATED : August 8, 1989

INVENTOR(S) : TOSHIYUKI YOSHIHARA, ET AL.

It is certified that error appears in the above-identified patent and that said Letters Patent is hereby corrected as shown below:

COLUMN 11

Line 36, "te" should read --the--.

COLUMN 13

Line 6, "Comparative Example 4" should read --Comparative Example 5--.

Line 16, "

| $V_0$ | $V_5$ | $E_{\frac{1}{2}}$ (visible) | $E_{\frac{1}{2}}$ (780 nm) | $V_5^{1000}$ " |
|---|---|---|---|---|

should read --

| $V_0$ (-V) | $V_5$ (-V) | $E_{\frac{1}{2}}$ (visible) ($\mu J/cm^2$) | $E_{\frac{1}{2}}$ (780 nm) | $V_5^{1000}$ (-V) --. |
|---|---|---|---|---|

Lines 18-19, "Comparative Example 4" should read --Comparative Example 5--.

Line 23, "4," should read --5,--.

Line 29, "first charge generating material" should read --first charge-generating material--.

UNITED STATES PATENT AND TRADEMARK OFFICE

CERTIFICATE OF CORRECTION

PATENT NO. : 4,855,202

DATED : August 8, 1989

INVENTOR(S) : TOSHIYUKI YOSHIHARA, ET AL.

It is certified that error appears in the above-identified patent and that said Letters Patent is hereby corrected as shown below:

COLUMN 14

Line 2, "acetate/polymethylacrylate," should read --acetate/polymethacrylate,--.

Signed and Sealed this

Eleventh Day of September, 1990

*Attest:*

HARRY F. MANBECK, JR.

*Attesting Officer*

*Commissioner of Patents and Trademarks*